US005392936A

United States Patent [19]

Solomon et al.

[11] Patent Number: 5,392,936

[45] Date of Patent: Feb. 28, 1995

[54] RUBBER TRACK PIPELAYER BOOM

[75] Inventors: James M. Solomon, Tulsa; Loyd J. Killgore, Council Hill; George A. Lehman, Beggs, all of Okla.

[73] Assignee: Sabre International, Inc., Tulsa, Okla.

[21] Appl. No.: 187,689

[22] Filed: Jan. 26, 1994

[51] Int. Cl.[6] ..... B66C 23/44

[52] U.S. Cl. ..... 212/258; 296/95.1; 212/271

[58] Field of Search ..... 212/258, 271, 206; 414/920; 296/95.1

[56] References Cited

U.S. PATENT DOCUMENTS

| | | | |
|---|---|---|---|
| 2,413,529 | 12/1946 | Swaney | 212/258 |
| 2,712,873 | 7/1955 | Peterson | 212/258 |
| 2,885,092 | 5/1959 | Murrey | 212/258 |

FOREIGN PATENT DOCUMENTS

| | | | |
|---|---|---|---|
| 703490 | 12/1979 | U.S.S.R. | 212/258 |

*Primary Examiner*—Michael S. Huppert
*Assistant Examiner*—Thomas J. Brahan
*Attorney, Agent, or Firm*—Scott R. Zingerman; Frank J. Catalano

[57] ABSTRACT

A pipelayer machine including a tractor with rubber mounted tracks and a boom supported by the tractor for lifting and lowering the pipe to be laid. The boom is pivoted on one side of the tractor, and the boom line winch is supported on the other side. The boom line crosses in front of the windshield of the tractor and there are specially designed boom line cable fairleads at each front corner of the cab to prevent damage to the windshield and to the driver within the cab.

5 Claims, 6 Drawing Sheets

RUBBER TRACK PIPELAYER BOOM

BACKGROUND OF THE INVENTION

This relates to a pipelayer and tractor for use in laying pipe in a previously dug trench. It relates especially to modifications of commercially available tractors and improvements to commercially available pipelayer attachment to obtain a new and useful tractor with pipelayer attachments.

Pipelines are used throughout the country as a means of conveying products such as gasoline, gas, fuel, water, etc. from one location to a selected destination. A trench of selected size, width and depth is dug, usually by use of ditching machines. After the trench has been dug, a pipelayer to apparatus follows which is usually self-propelled and is driven along the path of the trench. This apparatus has a pipelayer attachment attached to the tractor for lifting the pipe from the ground and lowering it into the trench. After the pipe is lowered and desired tests are made, the trench is then filled.

In the past the tractor normally had steel tracks which was all right in open terrain but could not be driven down modern highways. Therefore, it has been a recent practice to use a tractor with a rubber track. One such tractor is the Caterpillar model CHALLENGER TM 65 factor manufactured and sold by the Caterpillar Incorporated of Peoria, Ill. This tractor can be driven down hard surfaced roads without damaging the road surface. A pipelayer apparatus is attached to this tractor. One such attachment that has been used is a Model M-30RT available from Midwestern Manufacturing Company of Tulsa, Okla.

Although this combination would function, we found that there are several areas where improvements were highly desirable and needed to make the combination of the tractor and pipelayer a suitable unit. We discovered that the visibility was not as good as desired due to the cross support over the hood of the tractor right in front of the operator cab. Other shortcomings, together with modifications and improvements will be discussed hereinafter.

SUMMARY OF THE INVENTION

We have designed a pipelayer attachment and modified an existing Caterpillar CHALLENGE TM Model 65 tractor so that when the attachment and the tractor are combined into a unit with our additions and changes, it eliminates or reduces problems previously encountered as set forth herein. The particular tractor which was modified had an elongated fuel tank on the left side and one on the right side and a counterweight at the rear of the tractor. In the prior system the boom was adapted to be supported on one side of the tractor at an elevation above the existing fuel tank. We removed the fuel tank on the side of the tractor opposite where the boom is supported and put a counterweight in the space previously occupied by the removed fuel tank. This counterweight greatly reduced the tilting or tipping problem which was previously encountered.

The boom attachment of our invention includes a cab rack which is designed to protect the cab. This cab rack is supported from the tractor. This rack includes two essentially vertical front frames, one on either side of the windshield of a tractor. These two frames each support a boom line cable fairlead. These fairleads are supported on pivots such that each fairlead can roll about its longitudinal axis. The boom line is driven by a winch supported on the side of the tractor opposite that on which the boom is located. The boom line then goes across in front of the windshield. We provide the boom line cable fairleads to protect the windshield and the driver. Thus the boom line extends from the boom winch, in front of the fairleads, to the boom block. The boom line is used for raising and lowering the boom about the pivots which support the boom.

A load line extends from the load winch supported by the tractor and over a load line block supported at the top of the boom to raise and lower loads such as pipe. In a preferred embodiment, a cable tray extends through the lower side of the engine compartment of the tractor for channeling the load line. This preferred embodiment also includes a fuel tank only on the side of the tractor from which the boom is supported and a counterweight on the opposite side of the tractor from the fuel tank. In this basic preferred embodiment the modified tractor includes a stop means supported by the tractor to stop the boom winch so as to restrict the forced movement of the boom about its pivot. A utility attachment can be supported at the rear end of the tractor where a previous counterweight had been located and removed.

It is an object of this invention to provide a tractor with pipe laying attachments which has improved stability. It is still a further object in which the improved tractor pipelayer combination unit has greater visibility and provides protection for the operator.

These and other objects will become apparent from the description which follows in view of the drawings, in which:

DETAILED DESCRIPTION OF THE PREFERRED EMBODIMENT

Figure 3:
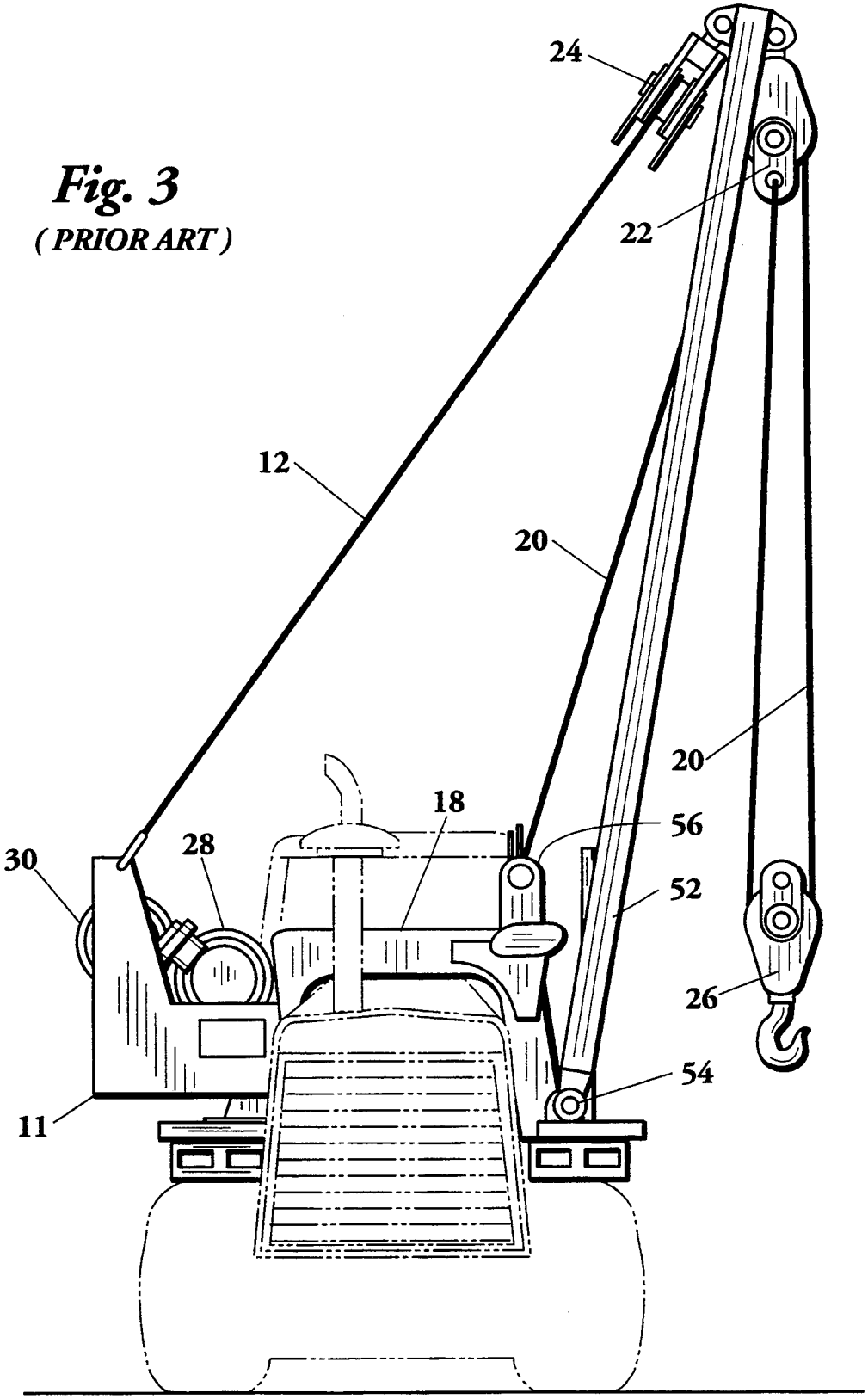
Fig. 3 (PRIOR ART)
FIG. 3 illustrates a front end view of a prior tractor pipe laying apparatus.
Figure 6:
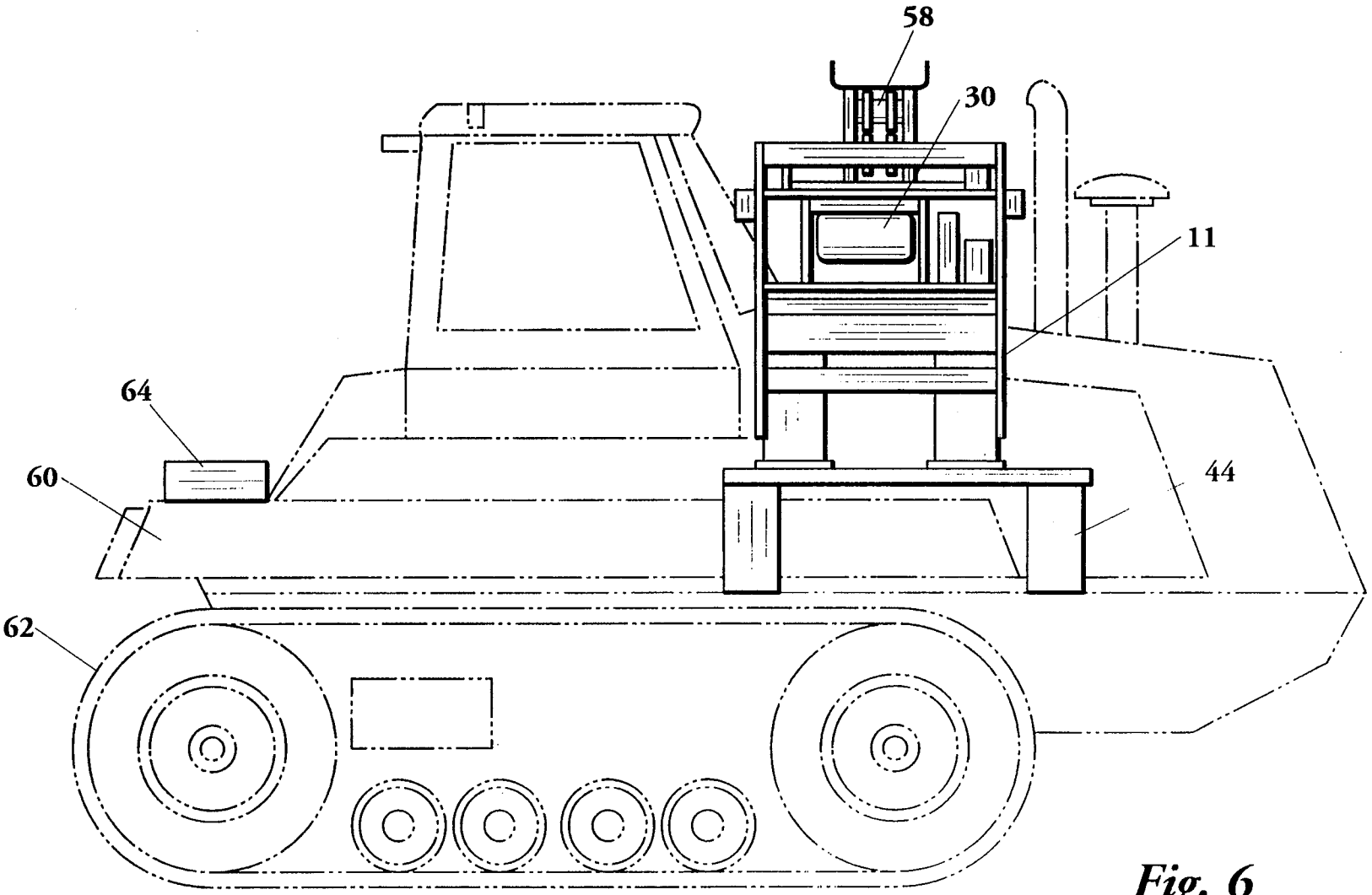
Fig. 6 (PRIOR ART)
FIG. 6 illustrates the right-hand side view of the prior tractor pipelayer equipment shown in FIG. 3.

Attention is first directed briefly to FIGS. 3 and 6 which illustrate the closest prior art of which Applicant is aware. This explanation is considered helpful in explaining the improvements and modifications which have been made. Attention is first directed to FIG. 3 which illustrates a conventional farm tractor such as a Caterpillar® CH-65 which was originally designed primarily for use on large farms in the raising of agricultural products. As shown, this tractor to has been equipped with a commercially available pipelayer, such as Model M-30RT from Midwestern Manufacturing Company for use in laying pipe in trenches. Also shown in FIG. 3, attached to the tractor, is a drawworks frame 11 and a boom 52. A boom line 12 is connected to boom winch 30 which is used to raise and lower the boom to and from the upright position shown in FIG. 3 to an extended position in which the boom is forced by gravity to rotate about pivot 54 which is supported from the tractor. The boom line 12 extends over a boom box 24, and the tethered line is connected back to the frame 30 in a normal manner. The boom 52 is provided with a top load line block 22 and a travel block 26. A load line 20 extends from top load line winch 28 through a pulley 56 over the top load line block 22 and down to support the traveling block 26.

FIG. 6 is a side view of the prior art device of FIGURE 3 except that the boom, the boom line and the load line extension is not shown. This side view is of the side of the tractor opposite the boom support. Shown thereon is a drawwork frame 11, drawwork base frame 44, a boom winch 30, a boom line support pulley 58, and a fuel tank 60 which extends horizontally co-extensive with the length of track 62. The conventional tractor shown in FIG. 6 is also provided with a rear counterweight 64.

The attachment shown in the prior art was complicated. We discovered that the attaching Of a conventional boom to a conventional tractor did not result in as efficient and operable pipelayer machine as was required.

Figure 1:
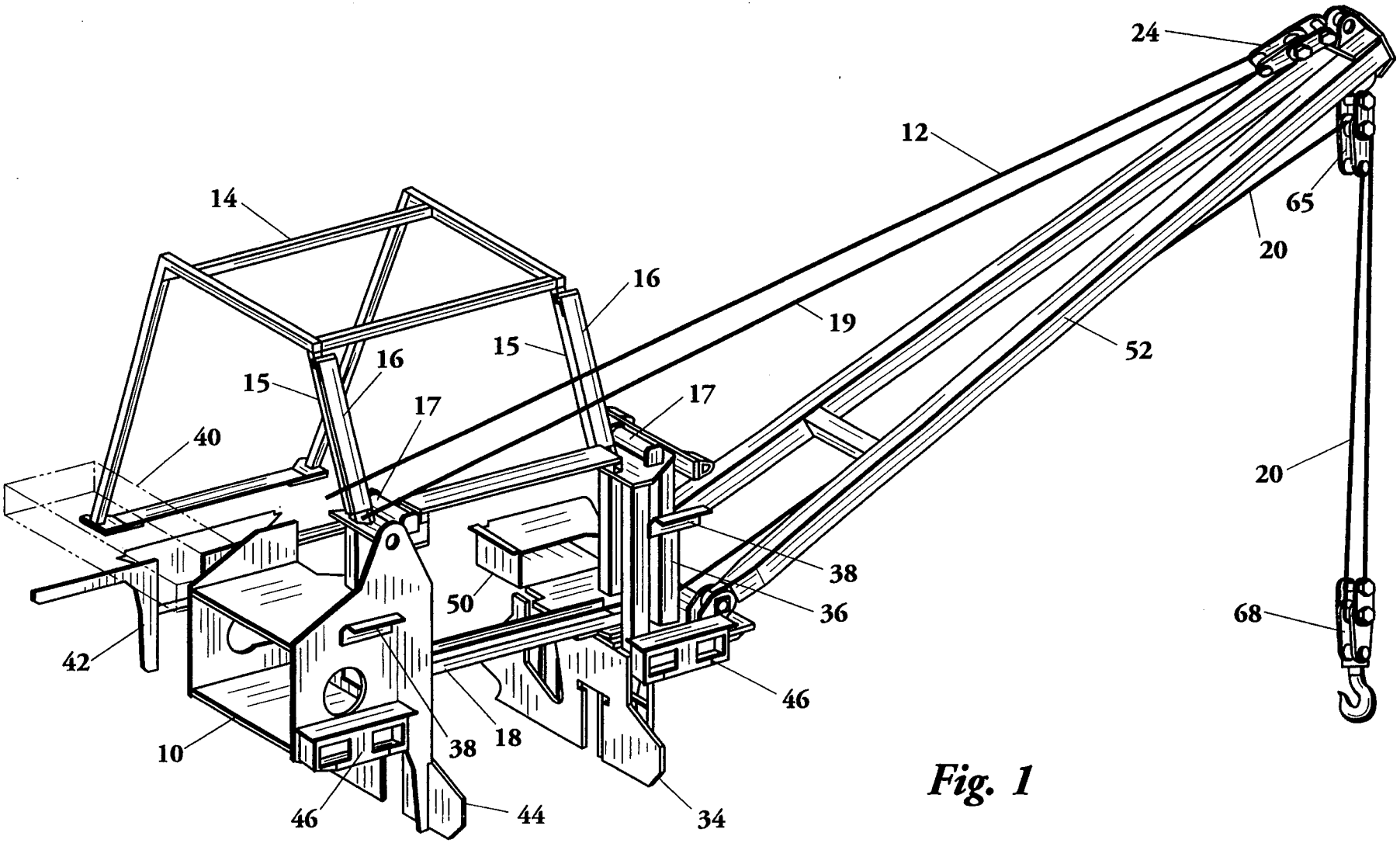
FIG. 1 is an isometric view showing the improved pipelayer attachment of our invention.
Figure 4:
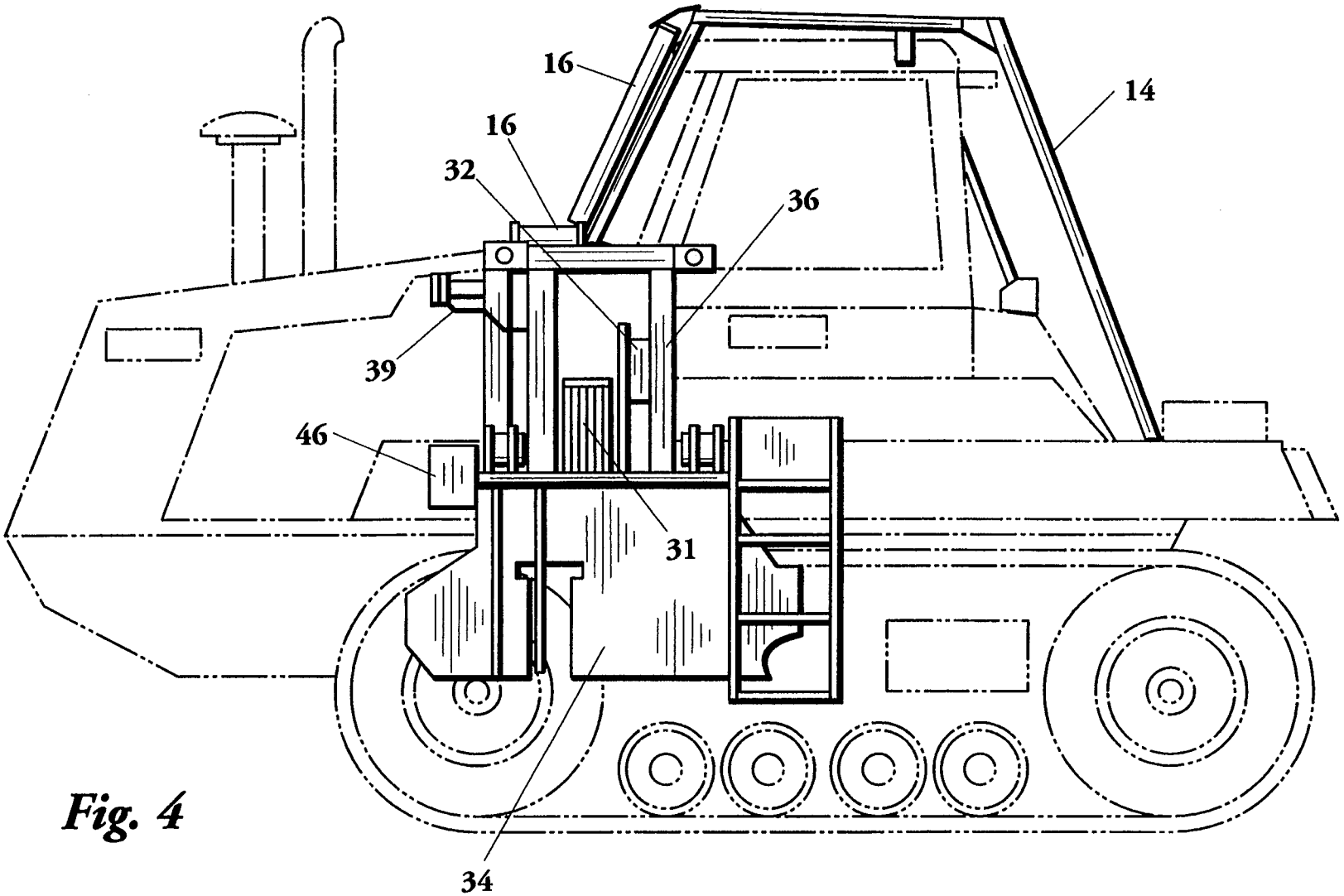
FIG. 4 illustrates the left side view of the tractor rig of FIG. 2.
Figure 5:
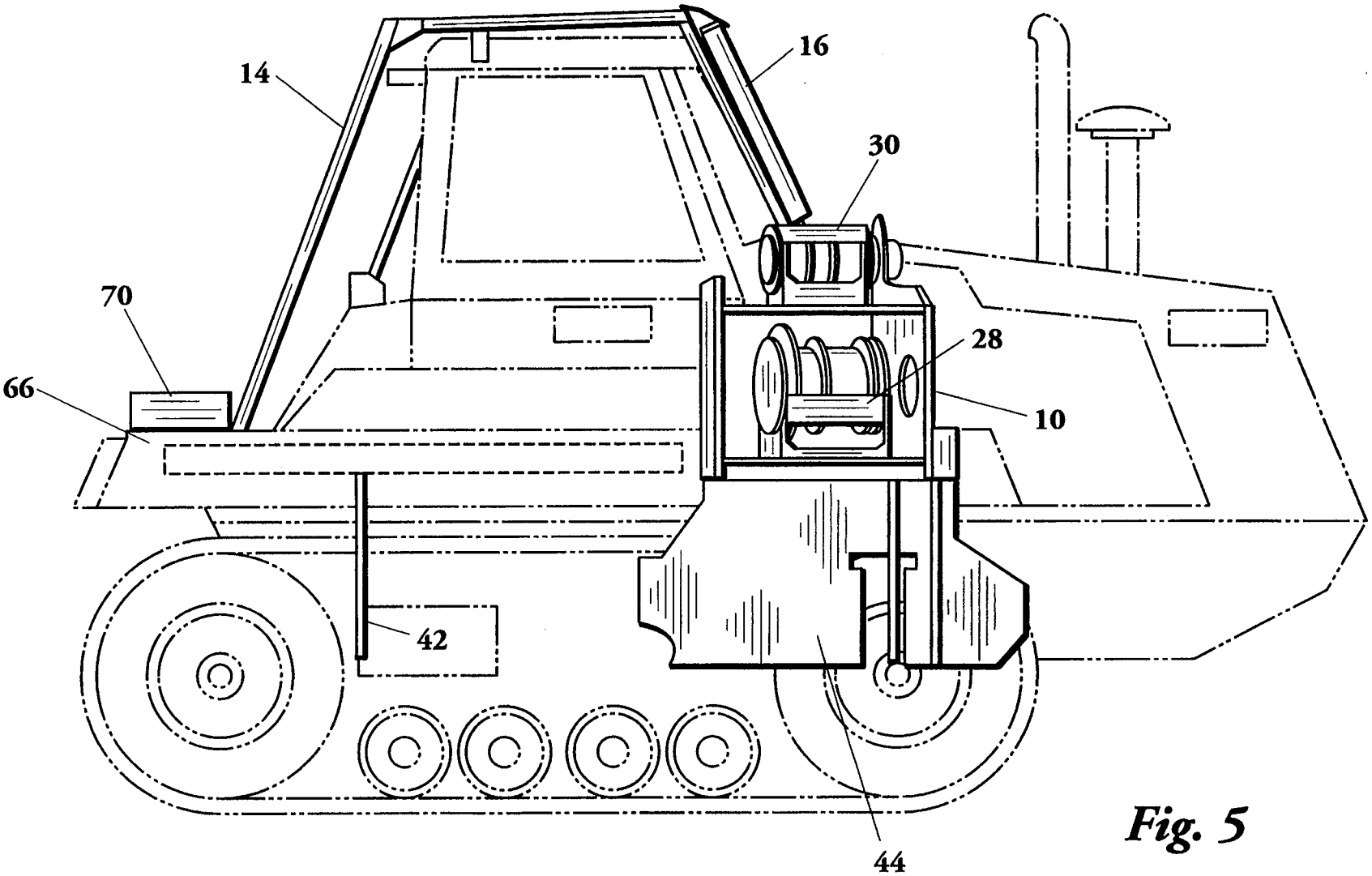
FIG. 5 illustrates the right-hand side of the tractor pipelayer equipment of FIG. 2.

We have made several changes, additions, and modifications to the prior art system of merely placing a conventional pipelayer boom onto a conventional farm tractor in order to make it more acceptable to use in laying pipe. One change was to increase stability to avoid tilting of the unit. To accomplish this, we removed the right-hand fuel tank 60 from the tractor and replaced it with a counterweight 66. This counterweight 66 is supported by a counterweight fender bracket 42 as shown in FIG. 1 and also in FIG. 5. The counterweight 66 does not extend as far forward as a gas tank 60 in the prior art. We have taken advantage of this so that we can lower the drawwork frame 10 so that it has a lower center of gravity than that of the prior attachments. Shown in FIG. 5 is a load winch 28, drawworks frame 10, and boom winch 30. As clearly seen in FIGS. 1, 4, and 5, the drawworks 10 of the present invention is much lower than that of drawworks 11 of the prior art as shown in FIG. 6. We accomplished this when we removed the tank 60 and replaced it with a counterweight which did not extend forward as far as the front end of the fuel tank. Thus, we were able to have space to lower the drawwork 10 to that shown. The boom line is connected to the boom winch 30 and extends, as shown in FIG. 1, in front of the front windshield up to a boom block 24 and back to attachment 13 on the frame of the tractor.

FIG. 1 shows a pipelayer to be attached to a tractor. It has a cab rack 14 which has an essentially vertical front corner frame which is located adjacent the two substantially vertical corners of the front windshield of a tractor. We will now show structure which protects the windshield and the operator from the boom line.

Figure 2:
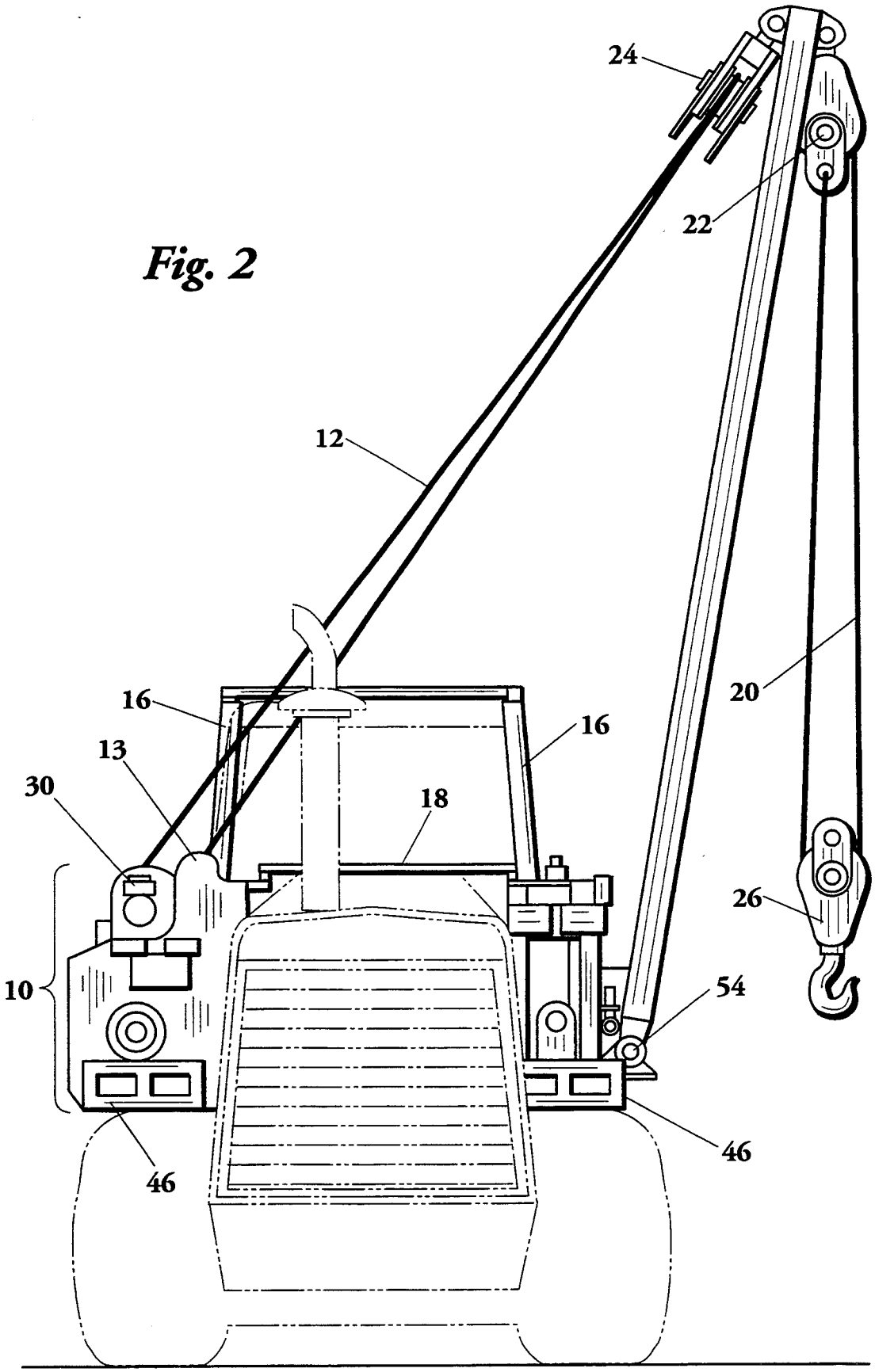
FIG. 2 is a front end view of an improved tractor and pipelayer attachment incorporating our invention.

As seen in FIG. 1, when the boom is extended or lowered to its operating position such as shown in FIG. 1, boom line 12 extends across the windshield of the tractor to boom line winch 30 shown in FIG. 5. Tether line 19 is the outer end portion of boom line 12 and attaches at point 13 as shown in FIG. 2 to the frame of the pipelayer attachment. We have protected the windshield from the boom line 12 by providing two substantially vertical boom line fairleads 16 which extend along the front edges 15 of cab rack frame 14. These are rollers which roll about a longitudinal axis which is supported so that the cable fairleads 16 can easily be rotated as the cable may contact and roll over it. Also provided are essentially horizontal boom line cable fairleads 17 which are supported from the tractor or cab frame such that the rollers of the fairlead can rotate about its axis which is essentially horizontal. This is a unique arrangement and prevents damage to the windshield which may be caused by wire cable 12 or 15 contacting it.

Load line 20 passes over a load line block 65 which is supported at the end of the boom 52 and extends around the load line hook block 68 and back up to be attached to block 65 in a conventional manner. The load line 20 extends back down along the boom to and undersheave 31 (see FIG. 4), along a cable tray or load line cross brace 18 which is positioned beneath the engine compartment, and continues on to the load winch 28 (FIG. 5). This prevents the load line from passing in front of or above the engine as was previously the case. This, of course, improves the visibility to the front of the machine, especially to the right. The dropping of the drawworks 10 also helps in this regard.

We also remove the counterweight 64 shown in FIG. 6 and have the possibility to add a utility attachment 70 such as a retrieval winch, as indicated in FIG. 5.

FIG. 1 also shows additional utilitarian features. These include: Light brackets 38, head light box 46, drawworks base frame 44, boom base frame 34, and a boom stop frame 36. An electric eye bracket 39 (FIG. 4) is provided with electric eyes so that when the boom 52 reaches that eye, the boom winch is shut off. A ladder step 50 is provided.

Our invention covers a specially designed pipelayer attachment together with modifications to the tractor which become an integral unit and accomplishes several very important improvements. These include the following points:

a. A unique fairlead (16,17) supported by a cab rack, protects the front windshield and operator from the boom line which in our modification runs over the hood of the engine and in front of the cab.

b. Incorporates a counterweight in the space the right fuel tank occupied before it was removed. The counterweight is concealed inside the fender itself and gives increased stability to the pipelayer-tractor unit and helps prevent tipping.

c. A cable tray has been fabricated and installed in the bottom of the engine compartment which improves the visibility to the front, left, and right of the machine by keeping the cable low, i.e. below the line of sight of the operator. This cable tray is for the load lead line cable 20.

d. By removing a part of the fuel tank and lowering the drawworks frame, we are able to place the pipelayer attachment closer to the ground and further toward the rear of the machine which increases stability and lifting capacity through improved and better balanced leverage on the load.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A pipe laying apparatus having:

a tractor having a front and a rear, an engine compartment, and a rubber drive track on each side of the tractor;

a driver's cab having a front left and front right mostly vertical corners;

a support frame having two front corners and mounted on said tractor and extending about said cab, said frame having an essentially vertical fairlead on each of the two front corners of said support frame in the proximity of and to the front of the front left and front right vertical corners of said cab;

a boom supported from said tractor frame by pivots;

a boom winch supported from said tractor, on the side opposite said boom;

a boom line extending from said boom winch in front of and in at least operational contact with said fairleads to said boom for raising and lowering the boom about said pivots;

a load line extending from a load winch supported by said tractor and over a pulley supported by said boom to raise and lower loads.

2. An apparatus as defined in claim 1 including:

a fuel tank only on the side of said tractor from which said boom is supported;

a counterweight on the opposite side of said tractor from said fuel tank.

3. A pipe laying apparatus having:

a tractor having a front and a rear, an engine compartment, and a rubber drive track on each side of the tractor;

a driver's cab having a front left and front right mostly vertical corners;

a support frame having two front corners and mounted on said tractor and extending about said cab, said frame having an essentially vertical fairlead on each of the two front corners of said support frame in the proximity of and to the front of the front left and front right vertical corners of said cab;

a boom supported from said tractor frame by pivots;

a boom winch supported from said tractor, on the side opposite said boom;

a boom line extending from said boom winch in front of said fairleads to said boom for raising and lowering the boom about said pivots;

a load line extending from a load winch supported by said tractor and over a pulley supported by said boom to raise and lower loads;

a cable tray extending through the lower side of the engine compartment of the tractor for directing the load line;

a fuel tank only on the side of said tractor from which said boom is supported;

a counterweight on the opposite side of said tractor from said fuel tank.

4. An apparatus as defined in claim 3 including an electric eye supported by said tractor to shut down boom winch when movement of said boom about its pivot reaches a preselected position.

5. An apparatus as defined in claim 4 including a utility attachment supported at the rear end of said tractor.

* * * * *